US011434665B2

(12) United States Patent
Andersen

(10) Patent No.: US 11,434,665 B2
(45) Date of Patent: Sep. 6, 2022

(54) SAFETY GATE

(71) Applicant: Jesper Birk Andersen, Kowloon (CN)

(72) Inventor: Jesper Birk Andersen, Kowloon (CN)

( * ) Notice: Subject to any disclaimer, the term of this patent is extended or adjusted under 35 U.S.C. 154(b) by 374 days.

(21) Appl. No.: 16/509,906

(22) Filed: Jul. 12, 2019

(65) Prior Publication Data

US 2020/0018097 A1 Jan. 16, 2020

(30) Foreign Application Priority Data

Jul. 12, 2018 (GB) ..... 1811437

(51) Int. Cl.
*E05B 65/00* (2006.01)
*A47B 88/50* (2017.01)
*E05B 65/46* (2017.01)

(52) U.S. Cl.
CPC ..... *E05B 65/0014* (2013.01); *A47B 88/50* (2017.01); *E05B 65/46* (2013.01)

(58) Field of Classification Search
CPC ..... E05B 65/0014; E05B 65/46; E05B 37/16; E05B 37/163; E05B 1/0038;
(Continued)

(56) References Cited

U.S. PATENT DOCUMENTS 5,711,554 A * 1/1998 Brown ..... E05B 65/0014 292/17
9,938,757 B2 * 4/2018 Raffi ..... E05C 19/188
2019/0040884 A1 * 2/2019 He ..... E05B 65/0014

FOREIGN PATENT DOCUMENTS

CN 201963078 U 9/2011
CN 105781257 A * 7/2016 ..... E05B 47/00
(Continued)

OTHER PUBLICATIONS

UK Search Report of Application Serial No. GB 1811437.1 dated Jan. 9, 2019, 1 page.

*Primary Examiner* — Kristina R Fulton
*Assistant Examiner* — Noah Horowitz
(74) *Attorney, Agent, or Firm* — Fay Sharpe LLP

(57) ABSTRACT

The invention relates to a latching mechanism that is attachable to the outer surface of a cupboard drawer or door to prevent opening of the drawer or door by a child. The child safety latch 1 thus locks and prevents opening of a first drawer or door element 2 with respect to a second cabinet frame element 3. The latch fitting mechanism 1 includes a first engaging part 4 and a second engaging part 5. The first and second engaging parts each comprise enlarged engaging surfaces 6, 7 respectively, which provide mating surfaces to securely fit the first and second engaging parts respectively to the surfaces of the first door or drawer element 2 and the second carcass element 3. Holes are provided in the engaging surfaces 6, 7 for attachment to the inside surface of a side of the drawer or cupboard with mechanical fasteners, such as screws. The enlarged surfaces 6, 7 also serve as substrates for other securing means such as adhesive or Velcro (hook and loop) type fixing means. The first engaging part 4 includes a prong assembly 8 arranged in a plane at 90 degrees to the enlarged attaching surface 6. The prong assembly 8 includes a pair of resilient prongs 10 each comprising a hooked terminal end 12. The second engaging part 5 includes a receiving means 9 arranged in the same plane as the enlarged attaching surface 7 and includes a pair of receiving prongs 11 each with a receiving hook 13 corresponding to the terminal ends 12 such that when the first and second engaging parts are brought together they are become automatically engaged, by the terminal end hooks 12 becoming latched to the receiving hooks 13.

15 Claims, 5 Drawing Sheets

(58) Field of Classification Search
CPC ..... E05B 2015/0448; Y10T 292/0809; Y10T 292/082; Y10T 292/0894; Y10T 292/0907; E05C 19/06; E05C 1/10; Y10S 292/37; A47B 88/50
See application file for complete search history.

(56) References Cited

FOREIGN PATENT DOCUMENTS

| | | | | |
|---|---|---|---|---|
| CN | 206233722 | U | 6/2017 | |
| CN | 206607986 | U | 11/2017 | |
| CN | 206667967 | U | 11/2017 | |
| WO | WO-2018100439 | A1 * | 6/2018 | ..... A44B 11/2519 |
| WO | WO 2018100439 | A1 | 6/2018 | |

* cited by examiner

SAFETY GATE

CROSS-REFERENCE TO RELATED APPLICATIONS

This application claims priority under 35 U.S.C. § 119, and the benefit of Great Britain Patent Application No. 1811437.1, filed Jul. 12, 2018 and titled "Safety Latch", the entirety of which applications are hereby incorporated by reference as if fully set forth herein.

The present invention relates to latches for drawers, cabinet doors and the like, and, more particularly, to safety latch fittings or "child-resistant" latches that include features which make them difficult to be actuated by small children.

BACKGROUND OF THE INVENTION

Drawers and cupboards are commonly used in daily life in kitchens, bedrooms, offices, etc. to store a wide range of articles, some of which may be harmful to children. Small children may also attempt to climb on, or even in, drawers and cabinets in an effort to play or hide, or retrieve contents from inside. Drawers and cabinets may store many types of materials which may be potentially hazardous to children such as medicines, household cleaners, knives, tools, paint, etc.

To prevent young children from accessing these storage areas, numerous devices have been patented and sold, most of a multi-piece assembly. Generally, a particular type of additional child safety latch has become popular which includes some sort of a longitudinal member with an opening or hook portion and a separate stop portion which are respectively attached to the cabinet frame and inside surface of a drawer or door respectively, or vice versa, to limit the amount the drawer or door may be opened. The hook portion may engage with a stop installed on a frame portion of the cabinet as the drawer or door is withdrawn so that only a small space then remains for an adult to insert their finger to depress the longitudinal member such that the hook may clear the stop on the frame of the enclosure.

In many cases, these latches require at least two components, which need alignment during installation or adjustment after installation. These components generally include a stop portion, or catch, attached to the enclosure and a hook portion attached to the inside of the drawer. This mechanism may further require a biasing member (springs, etc.) to bias the hook member against the stop member.

In one known drawer catch as disclosed in U.S. Pat. No. 4,505,526, a flexible hooked element is mounted to and projects rearwardly from a front wall of a drawer into the interior thereof. The hooked element is positioned to engage a catch on a downward facing surface of the cabinet which overlies the drawer. The drawer can be opened a limited amount until the hook engages the catch, at which time the user must manually flex the hook downwardly to disengage the catch. In this arrangement, the hook extends into the interior of the drawer such that it may interfere with access to the drawer interior as well as interfere with the contents thereof.

What is needed is a "child-resistant" safety latch that is easy to install on a surface of a drawer, or door, and which makes it sufficiently difficult for a child to operate to gain access.

One way of making it more difficult for a child to operate the latch is to increase the force required to move the latch. The force required to move the latch can be designed into the latch and specified in a range that is achievable by most adults but not achievable by small children, thus achieving an effective child proof latch. The disadvantage with relying on force however is that latches are typically made of plastic and with continued use over many operations of releasing the latch, the plastic components may creep and the tolerances of the release point of the hook and stop of the latch may change over time an result in the force required becoming less over time and at come, undetermined point in time the latch can become unsafe.

Similarly latches that rely on force to release them carry the risk that the adhesive strip, or other securing means, will not hold after repeated use over an extended period of time and the latch comes away from its mounting sufficiently to make the latch ineffective.

It is thus an object of the present invention to provide a child safety latch which may preferably be moulded of plastic to provide a low cost safety latch and which overcomes the above problems.

Accordingly there is herewith provided an invention for a child safety latch as defined by the appended claims.

There is now described an exemplary embodiment of the child safety latch mechanism of the present invention with reference to the following drawings:

DETAILED DESCRIPTION

Figure 1:
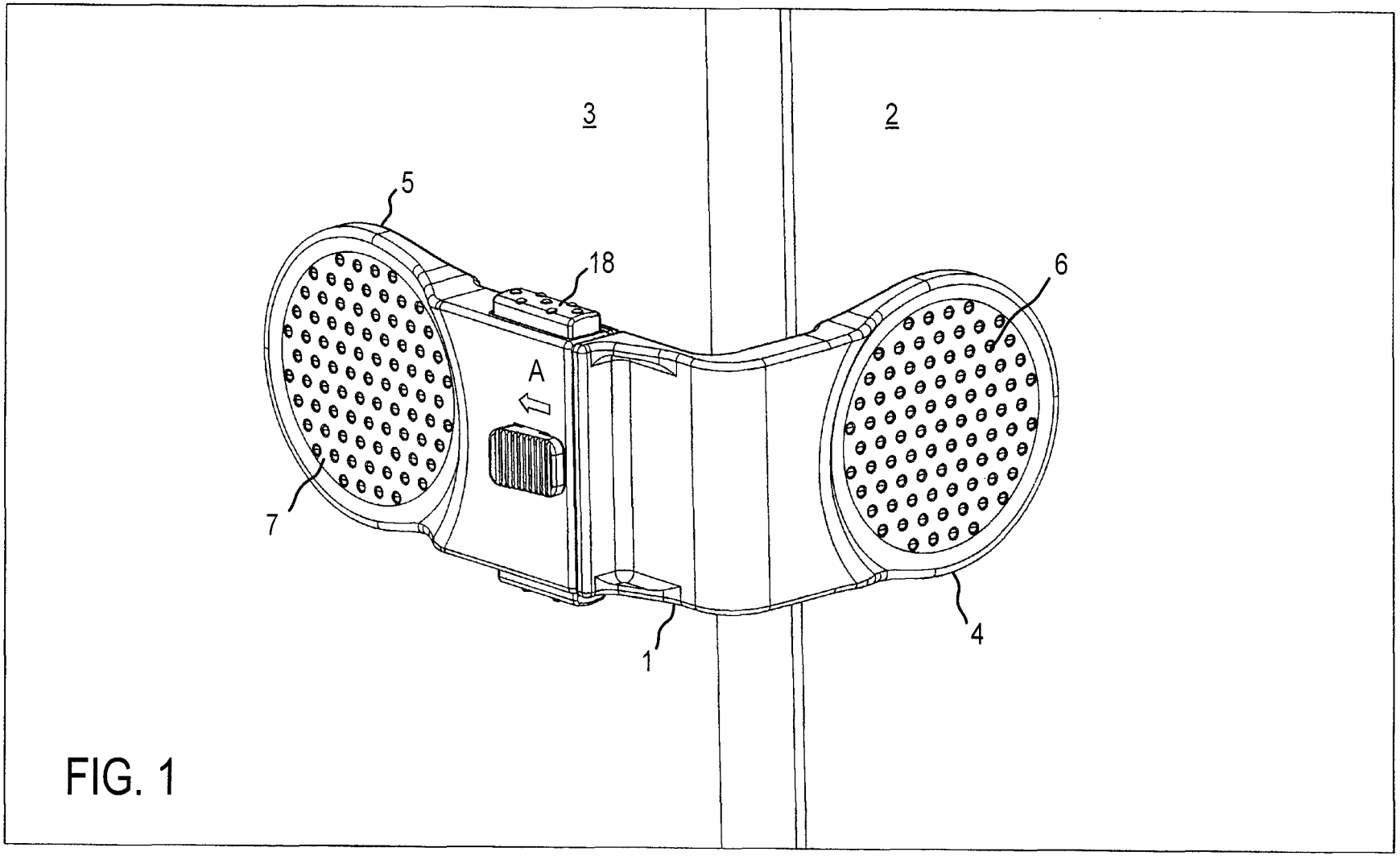
FIG. 1 shows a perspective view of an exemplary embodiment of the assembled child safety latch of the invention in the engaged position and attached to a cabinet with a drawer closed.

The present invention is described more fully hereinafter with reference to the accompanying drawings, in which preferred embodiments of the invention are shown. This invention, may, however, be embodied in many different forms and should not be construed as limited to the embodiments set forth herein; rather, these embodiments are provided so that this disclosure will be thorough and complete, and will fully convey the scope of the invention to those skilled in the art.

Referring now to FIGS. 1-5, a first exemplary embodiment of a childproof latch mechanism according to the present invention is described. The latching mechanism is attachable to the outer surface of a cupboard drawer or door to prevent opening of the drawer or door by a child. The child safety latch 1 thus locks and prevents opening of a first drawer or door element 2 with respect to a second cabinet frame element 3. The latch fitting mechanism 1 includes a first engaging part 4 and a second engaging part 5. The first and second engaging parts each comprise enlarged engaging surfaces 6, 7 respectively, which provide mating surfaces to securely fit the first and second engaging parts respectively to the surfaces of the first door or drawer element 2 and the second carcass element 3. Holes are provided in the engaging surfaces 6, 7 for attachment to the inside surface of a side of the drawer or cupboard with mechanical fasteners, such as screws. The enlarged surfaces 6, 7 also serve as substrates for other securing means such as adhesive or Velcro (hook and loop) type fixing means. The adhesive can be in the form of a peel-off strip so the user may simply remove the strip and press the latch fitting in the desired location to fit it.

Figure 3:
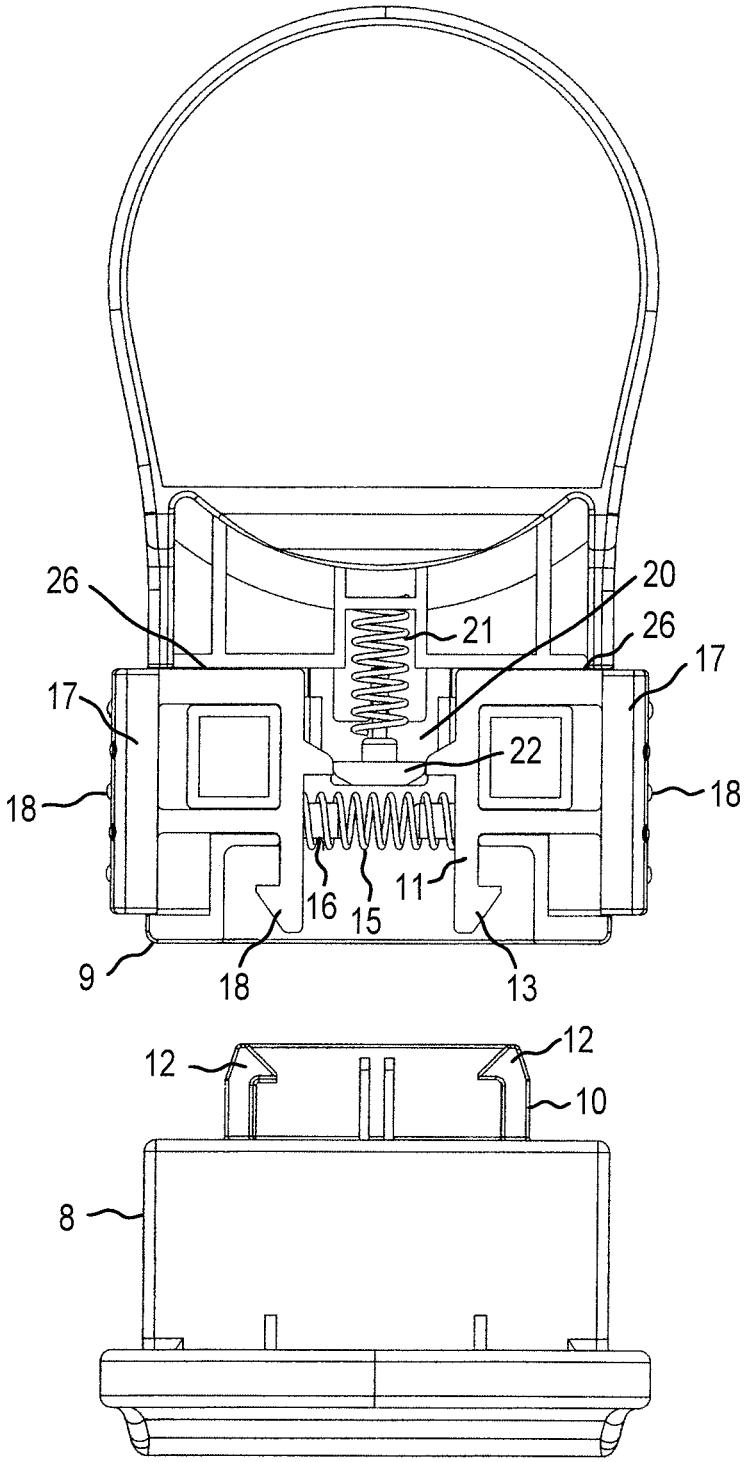
FIG. 3 shows a side elevation and partially sectional view of the child safety latch of FIG. 1, unattached to a cabinet, in the disengaged position.
Figure 4:
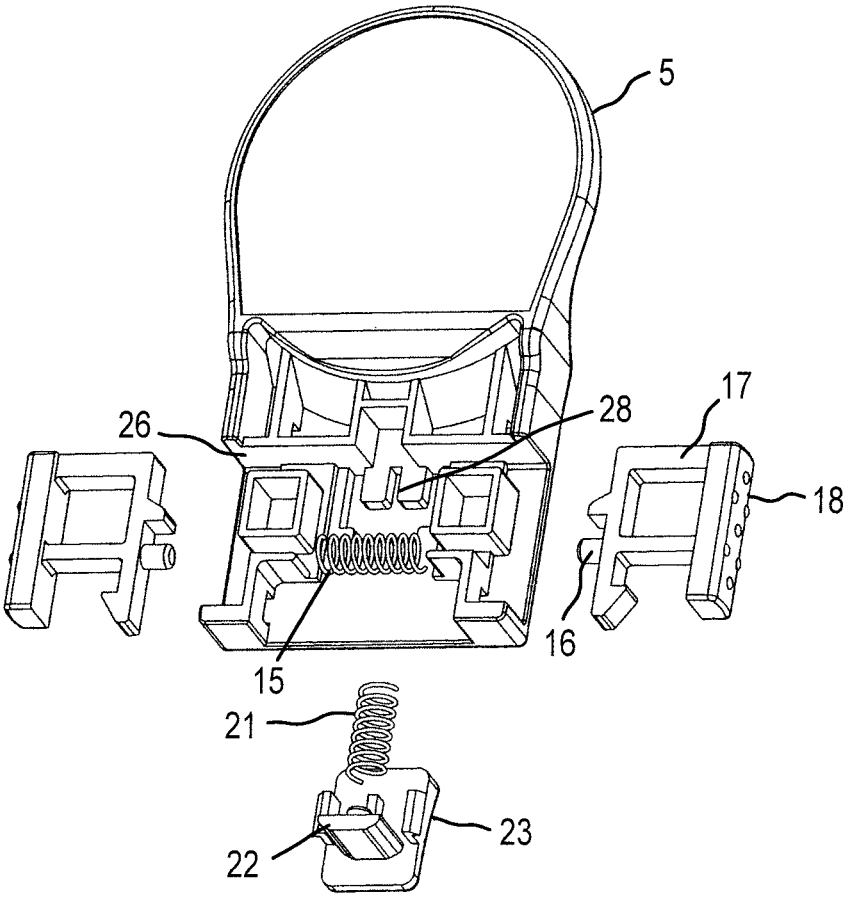
FIG. 4 shows a perspective view of the safety latch of FIG. 1, unattached to a cabinet, showing the internal mechanism, with the component parts unassembled and in the disengaged position, and, FIG. 5 shows a further perspective view of the assembled child safety latch of FIG. 1, attached to a cabinet, showing the operation of disengagement.
Figure 4:
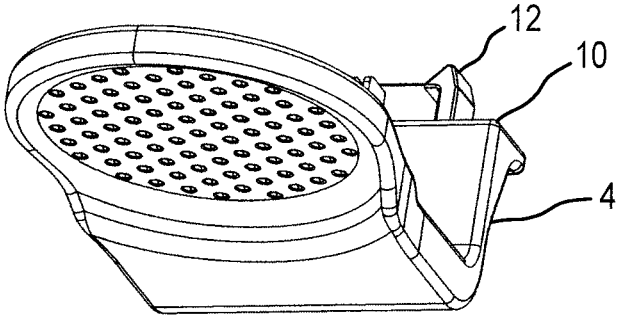

In this embodiment, as best shown in FIG. 3, the first engaging part 4 includes a prong assembly 8, with the prong assembly 8 arranged in a plane at 90 degrees to the enlarged attaching surface 6. The prong assembly 8 includes a pair of resilient prongs 10 each comprising a hooked terminal end 12.

The second engaging part 5 includes a receiving means 9 arranged in the same plane as the enlarged attaching surface 7 and includes a pair of receiving prongs 11 each with a receiving hook 13 corresponding to the terminal ends 12 such that when the first and second engaging parts are brought together they are become automatically engaged, by the terminal end hooks 12 becoming latched to the receiving hooks 13. The first and second engaging parts 4, 5 are preferably, but not limited to being, moulded of a resilient plastic.

Both the terminal ends 12 and the receiving hooks 13 have bevelled surfaces 18 so that when the first and second engaging means 4, 5 are brought together the corresponding bevelled surfaces 18 of the terminal ends 12 and the receiving hooks 13 causes the resilient prongs 10 and the receiving prongs 11 to resiliently bend allowing the terminal end hooks 12 to pass over the receiving hooks 13, at which point, due to the resiliency of the prongs 10 and the receiving prongs 11, the terminal end hooks 12 come to rest in an engaged position locked behind the receiving hooks 13.

The receiving means 9 also includes a spring 15 which is arranged between the receiving prongs 11 on corresponding spigots 16. Furthermore the receiving prongs 11 are arranged as part of corresponding actuatable sliding parts 17 which are arranged to slide in a direction orthogonal to the orientation of the receiving prongs 11. Each of these sliding parts 17 include corresponding user engagement surfaces 18 which are arranged externally and on each side of the second engaging part 5. Thus a user may apply pressure to the engagement surfaces 18 thus causing the sliding parts 17 two move inwardly against the action of the spring means 15 and which correspondingly moves the receiving prongs 11 towards each other just releasing prongs 10 and disengaging the first and second engaging parts 4, 5.

Figure 2:
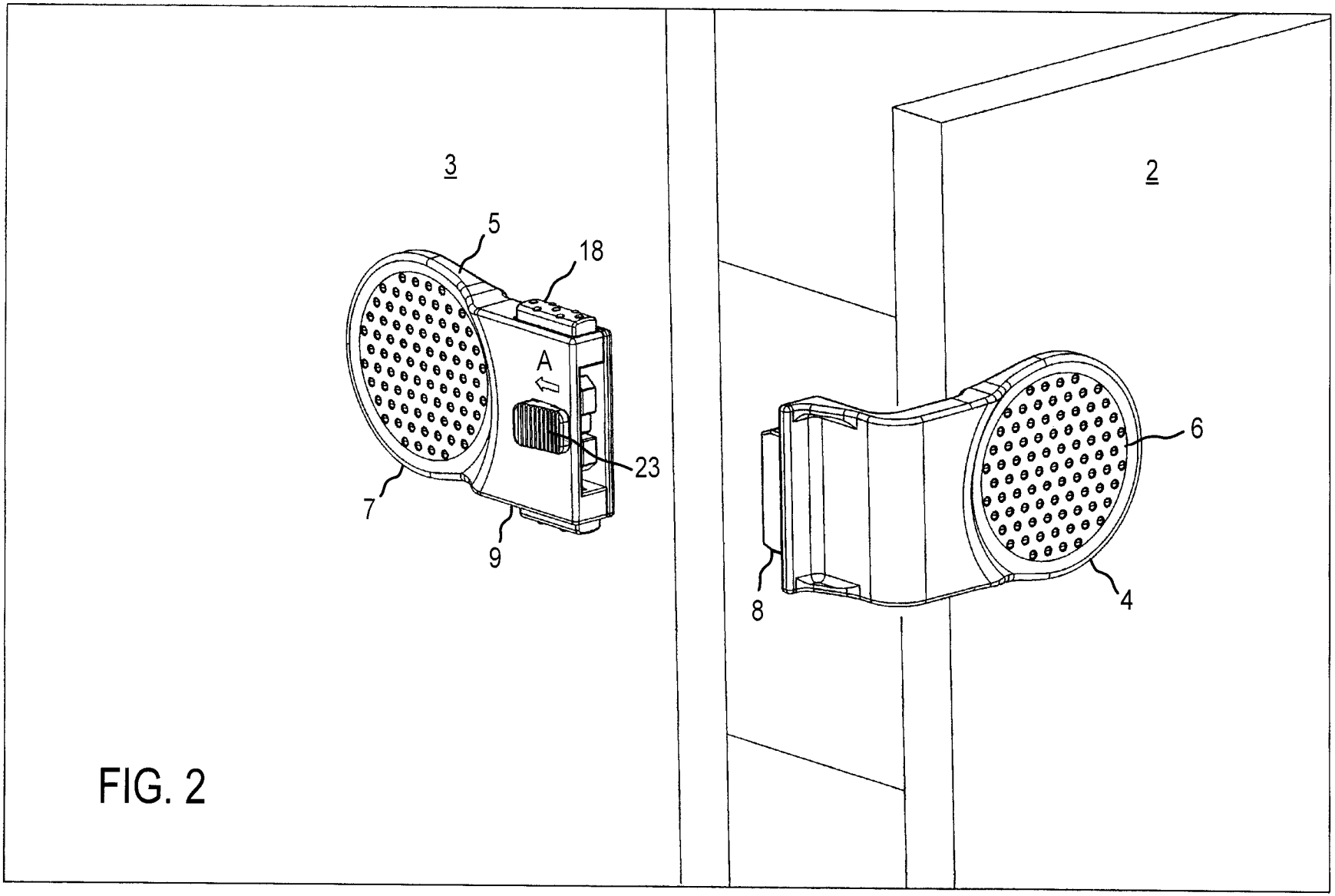
FIG. 2 shows a perspective view of the child safety latch of FIG. 1 attached to a cabinet, in the disengaged position with a drawer open.
Figure 5:
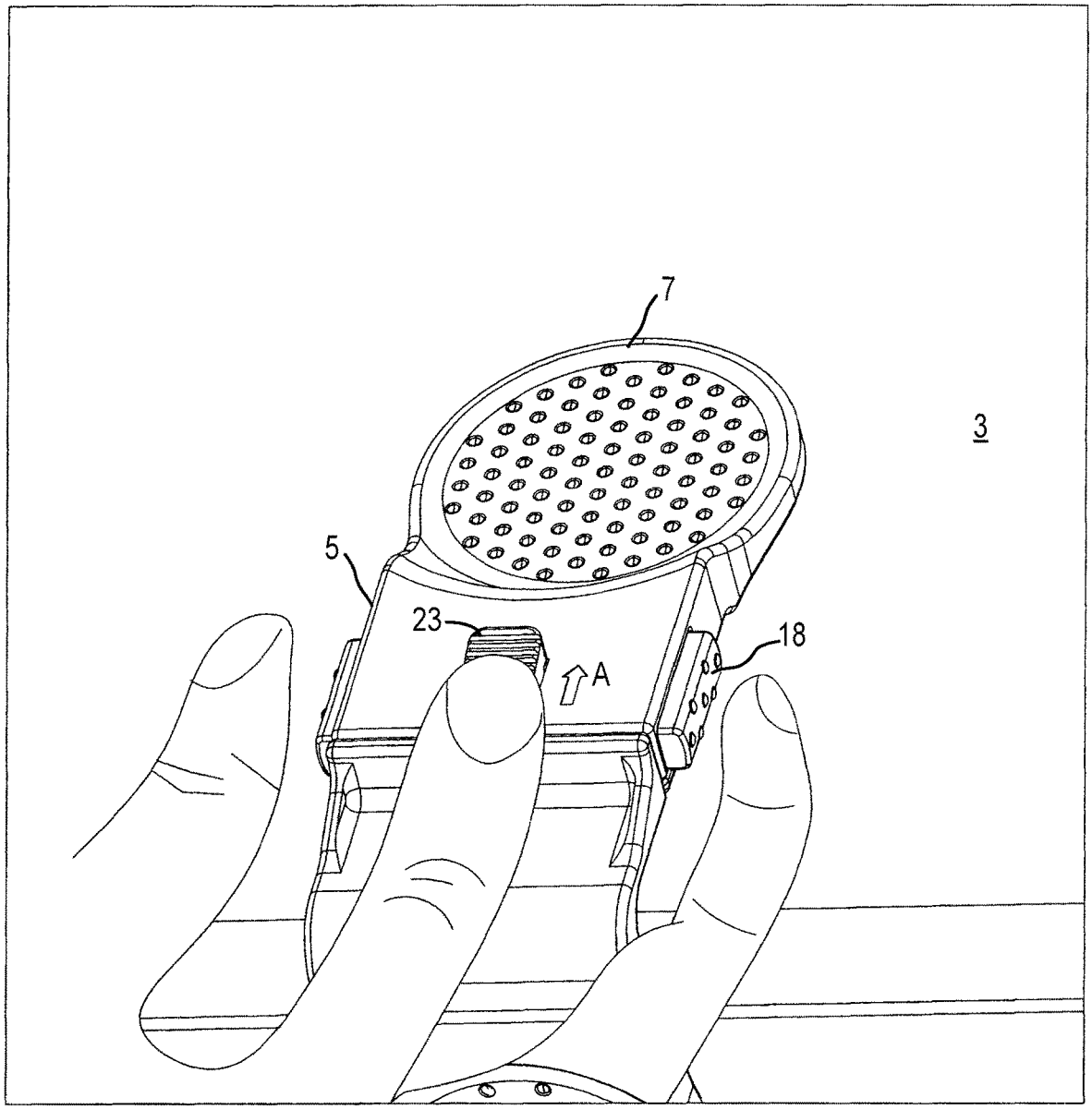

The receiving means 9 also includes a secondary lock 20 which is biased to a locked position by means of the secondary lock spring 21 in which the locking part 22 braces against corresponding abutments 24 of the sliding parts 17 preventing any inward movement of the sliding parts 17. The secondary lock has an outwardly facing operating surface 23 which can be engaged by the user and when moved in the direction of arrow A, as shown in FIGS. 1, 2 and 5, to an unlocked position against the spring 21. In this unlocked position the locking part 22 is out of alignment with the abutments 24, and inward movement of the sliding parts 17 is now possible.

The secondary lock spring 21 automatically restores the secondary locking part 22 to the locked position when released. The secondary lock spring 21 is arranged on a spigot on the secondary lock 20 and acts a surface of the second engaging part 5.

That the first and second engaging parts are made of rigid material and that the element securing section and the prong assembly are orthogonally arranged with respect to each other and the secondary lock is biased to the locked position by a resilient lock spring such that the spring automatically restores the secondary lock to the locked position when released, has the consequence that when the user closes the second element against the first element the first and second engaging parts are automatically engaged and secondary lock automatically sets to the locked position.

The second engaging part 5 also comprises fixed guide means 26 which provide support for the sliding part 17 and permit side to side movement of the sliding part 17.

The secondary lock is also slidably movable from the locked position to the unlocked position along secondary lock guide means 28 form as part of the second engaging part 5.

Thus referring now to FIG. 5 it can be seen that in order to release the latch it is necessary for the adult user to first move the secondary lock button 23 in the direction of arrow A using a first digit, then whilst holding this in the unlocked position, to press inwardly using second and third digits in opposing directions orthogonal to the direction of Arrow A. This required sequence of movement in distinctly different directions is key to the child safety performance of the latch. In general children below a certain critical vulnerable age cannot work out and perform this degree of complexity.

The fitting of the latch is made easy for the user so that lay person can easily fit the latch without the need for prior knowledge, training or tools. With the engaging parts in the latched together position, the enlarged sections 6, 7 are secured to the respective mutually orthogonal surfaces of the first and second elements in the desired position by removing peelable strips from the adhesive strips on the enlarged surfaces 6, 7 and then pressing the enlarged surfaces against the orthogonal surfaces. The latch is then immediately ready for use and may be tested by releasing and re-engaging the latch. The enlarged surfaces make it easy for the user to install the latch and also provide greater adhesive gripping force due to the larger area.

The latch may be a cabinet latch with the first element part of a cabinet frame and the second element a cabinet door, or alternatively the latch may be a drawer latch and the first element part of the drawer chest frame and the second element a drawer.

Thus, a childproof latch is provided which may be easily installed on the outside of a closure member without power tools or the need to measure.

It should be understood that although specific embodiments of the present invention have been described herein in detail, such descriptions are for purposes of illustration only and modifications may be made thereto within the scope of the invention.

COMPONENT LIST

1 Latch fitting mechanism
2 First door or drawer element
3 Second carcass element
4 First engaging part
5 Second engaging part
6 Enlarged engaging surface
7 Enlarged engaging surface
8 Prong assembly
9 Receiving means
10 Resilient prongs
11 Receiving prongs

12 Terminal end
13 Receiving hook
14 Not used
15 Spring
16 Spigots
17 Sliding parts
18 Use engagement surfaces
19 Not used
20 Secondary lock
21 Secondary lock spring
22 Brace
23 Operating surface
24 Abutments
25 Not used
26 Guide means
27 Not used
28 Secondary lock guide means

The invention claimed is:

1. A child safety latch for a cupboard or chest of drawers for preventing the unwanted movement of a first element with respect to a second element, said second element comprising a first surface which is orthogonal to a first surface of the first element said latch comprising:

a first engaging part comprising an element securing section being securable, and in use secured to, the first surface of the first element and a second engaging part being securable, and in use secured to, the first surface of the second element, the first engaging part comprising a prong assembly including a prong arm with a terminal end;

the second engaging part comprising a receiving means arranged for capturing the terminal end of said prong arm, said receiving means including a receiver to automatically receive and capture said terminal end to result in engagement of the first engaging part with the second engaging part, when the first and second engaging parts are moved together in a first direction, and thus to prevent movement of the first element with respect the second element;

wherein the first and second engaging parts may be disengaged by movement of the receiving means or prong arm in a second direction which releases the terminal end from capture by the receiving means and permits movement of the second element with respect to the first element, the movement of the receiving means or prong is effected by a disengaging means provided on the second engaging part which is actuatable by a user to release first and second engaging parts and wherein the receiving means or prong arm is resilient and returns to the first position after release by the user such that when the first element is moved back towards the second element, the latch is automatically reactivated the first and second engaging parts become engaged, the prong assembly including two prong arms each with a terminal end side by side and the receiving means includes two corresponding receivers to capture the respective terminal end and the second engaging part includes two corresponding disengaging means both of which need to be actuated by the user in order to disengage the first and second engaging parts and so release the first and second engaging parts and a secondary lock is provided which is biased to a locked position in which it prevents movement of at least one of the disengaging means until the secondary locked is first moved by the user to an unlocked position, characterized in that the first engaging part is made of rigid material and that the element securing section and the prong assembly are orthogonally arranged with respect to each other and the secondary lock is biased to the locked position by a resilient lock spring such that the spring automatically restores the secondary lock to the locked position when released, so that when the user closes the second element against the first element the first and second engaging parts are automatically engaged and secondary lock automatically sets to the locked position;

wherein the first engaging part is rigid and substantially L-shaped with the prong assembly arranged in a plane substantially orthogonal to the securing section;

wherein the prong assembly extends beyond the perimeter of the securing section; and wherein the receiving means is rigidly secured to the second element when the first and second engaging parts are disengaged.

2. A child safety latch according to claim 1, characterised in that the two corresponding disengaging means are required to be pressed by a user from opposing sides.

3. A child safety latch according to claim 2, characterised in that in the locked position the secondary lock braces against both of the corresponding abutment surfaces on each of the two disengaging means.

4. A child safety latch according to claim 1, characterised in that the two corresponding disengagement means are slidably movable from the engaged position to the disengaged position.

5. A child safety latch according to claim 2, characterised in that the secondary lock is slidably movable from the locked position to the unlocked position.

6. A child safety latch according to claim 5, characterised in that the secondary lock is moveable from the locked position to the unlocked position in a direction which is approximately orthogonal to the movement of the disengaging means from the engaged position to the disengaged position.

7. A child safety latch according to claim 1, characterised in that the secondary lock is engageable by the user and slidably moved in a first direction in a first step to release the brace and the disengaging means are arranged to then be free to be moved in a second and mutually opposing direction being in a plane which is orthogonal to the first direction to release first and second engaging parts and permit the second element to be moved with respect to the first element.

8. A child safety latch according to claim 1, characterised in that the first and second engaging parts each comprise an element securing section comprising and a circular element securing surface comprising an adhesive layer.

9. A child safety latch according to claim 8, characterised in that each element securing section comprises a user gripping surface on the opposite side thereof to the element securing surface which permits the user to press against the engaging parts to secure the latch to the respective elements when in the locked state.

10. A child safety latch according to claim 9, characterised in that the element securing sections are circular.

11. A child safety latch according to claim 10, characterised in that the element securing surface extends in a wider dimension than the prong assembly or receiving means respectively.

12. A child safety latch according to claim 1, characterised in that the latch is a cabinet latch and the second element is a part of the cabinet frame and the first element is a cabinet door.

13. A child safety latch according to claim 1, characterised in that the latch is a drawer latch and the second element is a part of the drawer chest frame and the first element is a drawer.

14. A child safety latch according to claim 12, characterised in that the first engaging part is coextensive with two orthogonal surfaces of the cabinet door.

15. A child safety latch according to claim 13, characterised in that the first engaging part is coextensive with two orthogonal surfaces of the drawer.

* * * * *